US007155386B2

(12) United States Patent
Gao

(10) Patent No.: US 7,155,386 B2
(45) Date of Patent: Dec. 26, 2006

(54) ADAPTIVE CORRELATION WINDOW FOR OPEN-LOOP PITCH

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 393 days.

(21) Appl. No.: 10/799,460

(22) Filed: Mar. 11, 2004

(65) Prior Publication Data

US 2004/0181397 A1 Sep. 16, 2004

Related U.S. Application Data

(60) Provisional application No. 60/455,435, filed on Mar. 15, 2003.

(51) Int. Cl.
*G10L 19/00* (2006.01)

(52) U.S. Cl. ..... 704/216; 704/207

(58) Field of Classification Search ..... 704/216–218, 704/207

See application file for complete search history.

(56) References Cited

U.S. PATENT DOCUMENTS 4,831,551 A * 5/1989 Schalk et al. ..... 704/233
4,989,248 A * 1/1991 Schalk et al. ..... 704/252
6,233,550 B1 * 5/2001 Gersho et al. ..... 704/208
6,453,287 B1 * 9/2002 Unno et al. ..... 704/219
6,526,376 B1 * 2/2003 Villette et al. ..... 704/207
6,691,082 B1 * 2/2004 Aguilar et al. ..... 704/219
6,873,954 B1 * 3/2005 Sundqvist et al. ..... 704/262
6,910,011 B1 * 6/2005 Zakarauskas ..... 704/233
6,990,453 B1 * 1/2006 Wang et al. ..... 704/270

OTHER PUBLICATIONS

"Pitch prediction filters in speech coding"; Ramachandran, R.P.; Kabal, P.; Acoustics, Speech, and Signal Processing [See also IEEE Transactions on Signal Processing], IEEE Transactions on vol. 37, Issue 4, Apr. 1989 pp. 467-478, Digital Object Identifier 10.1109/29.17527.*

"Jaynes' principle and maximum entropy spectral estimation"; Farrier, D.; Acoustics, Speech, and Signal Processing [see also IEEE Transactions on Signal Processing], IEEE Transactions on vol. 32, Issue 6, Dec. 1984 pp. 1176-1183.*

* cited by examiner

*Primary Examiner*—Michael N. Opsasnick
(74) *Attorney, Agent, or Firm*—Farjami & Farjami LLP

(57) ABSTRACT

An approach for adaptively adjusting the correlation window for open-loop pitch determination is presented. Correlation between a windowed reference signal (or target signal) and a candidate signal is maximized under most conditions by sliding the reference window by a delta increment in either direction to capture peak energy. The traditional fixed size of the correlation window is maintained. However, the window slides forward and/or backwards to capture peak energy within the window. The position of the adjusting or sliding window is allowed to shift in a small range or increment in either direction to maximize the energy of the windowed signal thus making sure that at least one peak energy is captured within the window.

15 Claims, 3 Drawing Sheets

ADAPTIVE CORRELATION WINDOW FOR OPEN-LOOP PITCH

RELATED APPLICATIONS

The present application claims the benefit of U.S. provisional application Ser. No. 60/455,435, filed Mar. 15, 2003, which is hereby fully incorporated by reference in the present application.

U.S. patent application Ser. No. 10/799,533, titled "SIGNAL DECOMPOSITION OF VOICED SPEECH FOR CELP SPEECH CODING."

U.S. patent application Ser. No. 10/799,503, titled "VOICING INDEX CONTROLS FOR CELP SPEECH CODING."

U.S. patent application Ser. No. 10/799,505, titled "SIMPLE NOISE SUPPRESSION MODEL", now U.S. Pat. No. 7,024,358.

U.S. patent application Ser. No. 10/799,504, titled "RECOVERING AN ERASED VOICE FRAME WITH TIME WARPING."

BACKGROUND OF THE INVENTION

1. Field of the Invention

The present invention relates generally to speech coding and, more particularly, to pitch correlation of voiced speech.

2. Related Art

From time immemorial, it has been desirable to communicate between a speaker at one point and a listener at another point. Hence, the invention of various telecommunication systems. The audible range (i.e. frequency) that can be transmitted and faithfully reproduced depends on the medium of transmission and other factors. Generally, a speech signal can be band-limited to about 10 kHz without affecting its perception. However, in telecommunications, the speech signal bandwidth is usually limited much more severely. For instance, the telephone network limits the bandwidth of the speech signal to between 300 Hz to 3400 Hz, which is known in the art as the "narrowband". Such band-limitation results in the characteristic sound of telephone speech. Both the lower limit at 300 Hz and the upper limit at 3400 Hz affect the speech quality.

In most digital speech coders, the speech signal is sampled at 8 kHz, resulting in a maximum signal bandwidth of 4 kHz. In practice, however, the signal is usually band-limited to about 3600 Hz at the high-end. At the low-end, the cut-off frequency is usually between 50 Hz and 200 Hz. The narrowband speech signal, which requires a sampling frequency of 8 kb/s, provides a speech quality referred to as toll quality. Although this toll quality is sufficient for telephone communications, for emerging applications such as teleconferencing, multimedia services and high-definition television, an improved quality is necessary.

The communications quality can be improved for such applications by increasing the bandwidth. For example, by increasing the sampling frequency to 16 kHz, a wider bandwidth, ranging from 50 Hz to about 7000 Hz can be accommodated. This bandwidth range is referred to as the "wideband". Extending the lower frequency range to 50 Hz increases naturalness, presence and comfort. At the other end of the spectrum, extending the higher frequency range to 7000 Hz increases intelligibility and makes it easier to differentiate between fricative sounds.

Digitally, speech is synthesized by various well-known methods. One popular method is the Analysis-By-Synthesis (ABS) method. Analysis-By-Synthesis is also referred to as closed-loop approach or waveform-matching approach. It offers relatively better speech coding quality than other approaches for medium to high bit rates. One ABS approach is the so-called Code Excited Linear Prediction (CELP) method. In CELP coding, speech is synthesized by using encoded excitation information to excite a linear predictive coding (LPC) filter. The output of the LPC filter is compared against the voiced speech and used to adjust the filter parameters in a closed loop sense until the best parameters based upon the least error is found.

Pitch lag is one of the most important parameters for voiced speech, because the perceptual quality is very sensitive to pitch lag. CELP speech coding approaches rely on determination of open-loop pitch to help minimize the weighted errors in the closed-loop speech coding process. Open-loop pitch is usually determined using normalized pitch correlation on a weighted speech signal. With this approach, it is desirable to maximize correlation between a windowed reference signal and a candidate signal. Thus, the correlation window size is traditionally limited to have a good local pitch lag, a reliable determination of small pitch lags, and acceptable complexity. However, because voiced speech is not purely periodic, this approach may fail when the local pitch lag is larger than the window size and/or when an energy peak is not located within the window.

The present invention addresses the issues identified above regarding pitch lag determination.

SUMMARY OF THE INVENTION

In accordance with the purpose of the present invention as broadly described herein, there is provided systems and methods for adaptively adjusting the correlation window for open-loop pitch determination.

Generally, for CELP speech coding, open loop pitch is determined using a normalized pitch correlation approach. In order to minimize weighted errors in the closed-loop process (e.g. CELP coding), pitch lag is estimated on the weighted speech signal. However, sometimes the correlation window for pitch lag estimation may fail to contain a complete pitch cycle thus making correlation difficult. If the window is too large, it may cause complexity problem and also increase the difficulty to detect a short pitch lag. Embodiments of the present invention provide methods to maximize correlation between a windowed reference signal and a candidate signal under most conditions by sliding the window by a delta increment in either direction to capture peak energy. The traditional fixed size of the correlation window is maintained. However, the window slides forward and/or backward to capture peak energy within the window.

In one embodiment of the present invention, the position of the adjusting or sliding window may shift in a small range or increment to maximize the energy of the windowed signal thus making sure that at least one peak energy is captured within the window. The methods of the present invention correct the possible errors in detection of large pitch lags without affecting the reliability of detecting small pitch lags.

These and other aspects of the present invention will become apparent with further reference to the drawings and specification, which follow. It is intended that all such additional systems, methods, features and advantages be included within this description, be within the scope of the present invention, and be protected by the accompanying claims.

DETAILED DESCRIPTION

The present application may be described herein in terms of functional block components and various processing steps. It should be appreciated that such functional blocks may be realized by any number of hardware components and/or software components configured to perform the specified functions. For example, the present application may employ various integrated circuit components, e.g., memory elements, digital signal processing elements, transmitters, receivers, tone detectors, tone generators, logic elements, and the like, which may carry out a variety of functions under the control of one or more microprocessors or other control devices. Further, it should be noted that the present application may employ any number of conventional techniques for data transmission, signaling, signal processing and conditioning, tone generation and detection and the like. Such general techniques that may be known to those skilled in the art are not described in detail herein.

Figure 1:
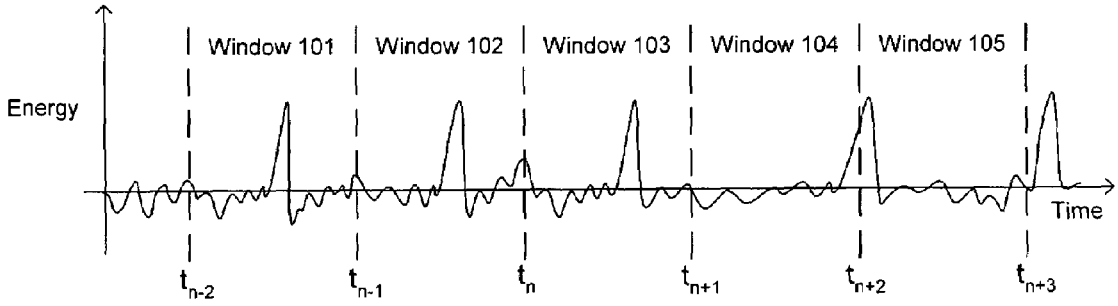
FIG. 1 is an illustration of the windowing of a time domain representation of the energy of a coded voiced speech signal.

FIG. 1 is an illustration of the windowing of a time domain representation of the energy (i.e. excitation) of a coded voiced speech signal. As illustrated, the voiced speech signal may be separated into segments (e.g. windows 101, 102, 103, 104, and 105) before coding. Each segment may contain any number of pitch cycles (i.e. illustrated as big mounds). For instance, segment 101 contains one pitch cycle while segment 104 contains no pitch cycles, and segment 105 contains two pitch cycles. The pitch cycles provide the periodicity of the speech signal.

Periodicity of pitch lag is used in ABS coding approaches such as CELP. One popular approach to detecting the periodicity or pitch lag of a voiced speech signal is the pitch correlation approach. In correlation, one segment of the speech signal is compared to another segment of the signal in order to maximize the correlation between these two segments. The goal is to obtain the pitch lag, which could be small or large in size, since voiced signal is not purely periodic.

The correlation window is traditionally limited to a certain size in order to obtain a good local pitch lag, a reliable determination of small pitch lags, and an acceptable complexity. However, a problem arises as illustrated in segment 104 where the real pitch lag is larger than the window size and an energy peak is not captured within the target window, which is traditionally on a fixed location.

Since the window size cannot be increased or decreased to cover all potential cases, one or more embodiments of the present invention seeks to maximize the energy in each correlation window by implementing a sliding target window. With this approach, the correlation target window may slide for a known delta in either direction. For example, if the window contains 80 samples, this 80-sample size is maintained, and the location of the target window is allowed to slide by a delta of 20 samples, for example, in either direction thus shifting a range of −20 to +20. The window size remains fixed.

Figure 2:
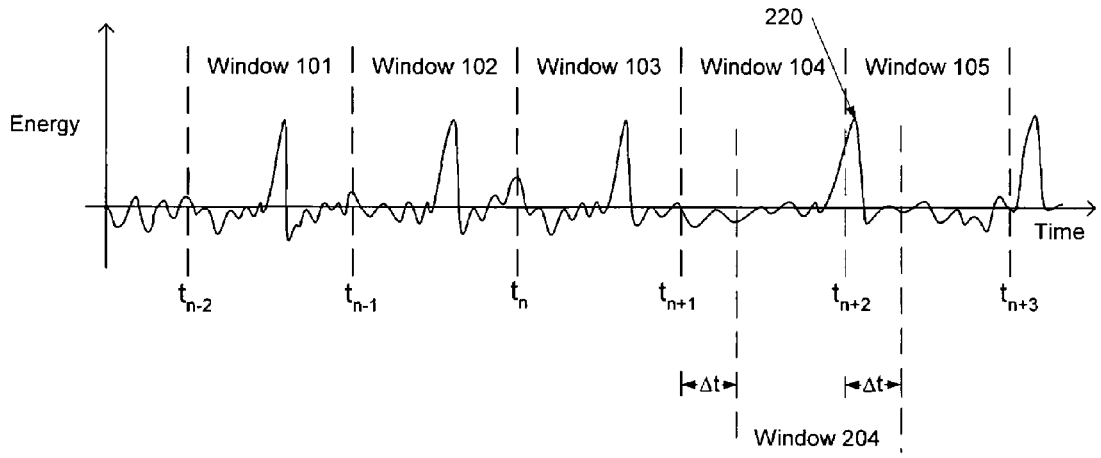
FIG. 2 is an illustration of the sliding window concept in accordance with an embodiment of the present invention.

FIG. 2 is an illustration of the sliding target window concept in accordance with an embodiment of the present invention. In this illustration, the original window 104 does not capture any peak energy; however, if the correlation window slides to the right by an amount Δt (e.g. N samples), more and more portions of the peak energy 220 is captured within the window (illustrated as window 204). (Note that the slide illustrated in FIG. 2 is exaggerated for clarity. In actual implementation, all that is required is to slide the window enough to capture the entirety of peak energy 220). As a result, a better correlation can be achieved between the previous window 103 and the new window 204, while complexity is not affected by maintaining the window size.

This approach is significant for wideband speech processing, since there is more irregularity or noise in the high frequency areas so that the distance between energy peaks may be more randomly spaced.

Figure 3:
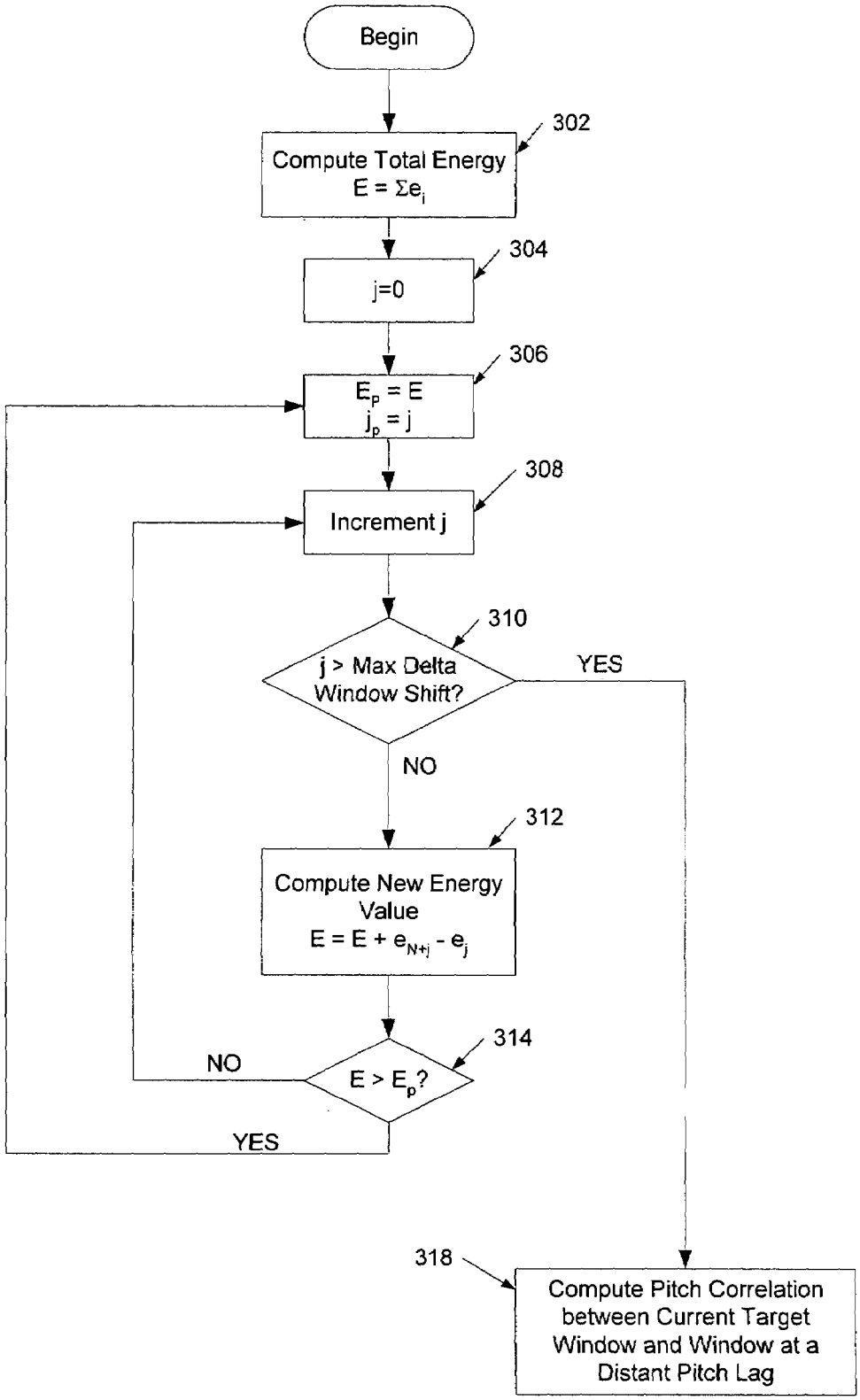
FIG. 3 is a flowchart illustration of a positive sliding window in accordance with an embodiment of the present invention.

It should be noted that the sliding window's computational complexity is minimal since as the window slides, a sample at one end is removed while a new sample at the other end is added to maintain the window size. Therefore, the energy calculations within the sliding window are made without affecting system complexity. FIG. 3 is a flowchart illustration of a positive sliding window in accordance with an embodiment of the present invention. Note that the correlation window may slide in either direction (positive or negative).

As illustrated, the total energy E within a correlation window of size N is computed in block 302. The total energy is the sum of all the energy values, e, at each sampling point, i, within the correlation window. In block 304 a counter (or sliding index) j for the slide width of the sliding window is initialized to zero and the total energy in the current (i.e. initial) window is saved into $E_P$ in block 306. Also, the current sliding index j is saved in $j_P$. The sliding index counter j is incremented in block 308 to move the correlation window to the right. In block 310, a determination is made to assure the maximum delta window shift value is not exceeded. If the maximum slide width is reached, in either direction, pitch correlation is computed by searching for possible pitch lags from the current determined target window and the window at a distant pitch lag.

If, on the other hand, a determination is made in block 310 that the slide width maximum has not been exceeded, a new energy value is computed for the for the new window in block 312 by adding the $(N+j)^{th}$ energy value to and subtracting the $j^{th}$ energy value from the total energy E. Note that the entire energy is not recomputed. In block 314, a determination is made if a maximum energy value has been found by checking the newly computed total energy value E against the saved energy value $E_P$. If E is greater than $E_P$, then $E_P$ and $j_P$ ($j_P$ memorizes the best window location) are updated. The computation continues the sliding window process by returning back to block 306 until reaching the maximum shift delta.

If, on the other hand, a determination is made in block 314 that E is not greater than $E_P$, then the computation continues the sliding window process by returning back to block 308 to increment the sliding index counter, j, until the maximum shift delta is reached. In block 318, pitch correlation is computed using pitch lag from the current determined target window and the window at a distant pitch lag.

Embodiments of the present invention may slide the window first to the one side, then to the other side in search of the maximum peak energy value. For instance, to move the window to the left may involve simply modifying the equation in block 312 to ($E=E-e_{N-j}+e_{-j}$), for example, in order to achieve a left shift. The idea is to maximize the energy of the windowed signal by providing at least one peak energy cycle within the correlation window.

Although the above embodiments of the present application are described with reference to wideband speech signals, the present invention is equally applicable to narrowband speech signals.

The methods and systems presented above may reside in software, hardware, or firmware on the device, which can be implemented on a microprocessor, digital signal processor, application specific IC, or field programmable gate array ("FPGA"), or any combination thereof, without departing from the spirit of the invention. Furthermore, the present invention may be embodied in other specific forms without departing from its spirit or essential characteristics. The described embodiments are to be considered in all respects only as illustrative and not restrictive.

What is claimed is:

1. A method of using a microprocessor for improving pitch determination, the method comprising:

obtaining an input voiced speech signal;

segmenting said input voiced speech signal into a plurality of windows of a sample size for pitch lag determination;

selecting a target window of said plurality of windows at an original position;

calculating a total energy of said target window by summing an energy of each of a plurality of samples within said target window;

sliding said target window in a first direction, with respect to said original position, by a sample to redefine said target window;

computing said total energy of said target window after said sliding;

repeating said sliding and said computing, for a pre-defined number of samples to obtain a total energy for each of said target windows;

determining a maximum total energy among every said total energy obtained from said target windows; and computing a pitch correlation based on said target window having said maximum total energy.

2. The method of claim 1, wherein after said repeating and prior to said determining, said method further comprising:

sliding said target window in a second direction opposite to said first direction, with respect to said original position, by a sample to redefine said target window;

computing said total energy of said target window after said sliding said target window in said second direction; and repeating said sliding said target window in said second direction and said computing, for said pre-defined number of samples to obtain a total energy for each of said target windows.

3. The method of claim 1, wherein said sliding maintains said sample size for each of said target windows.

4. The method of claim 1, wherein said computing said total energy includes adding an energy value of an added sample and subtracting an energy value of a removed sample to said target window as a result of said sliding.

5. The method of claim 1 further comprising coding said input voiced speech signal using said pitch correlation.

6. A computer program product comprising:

a computer usable medium having computer readable program code embodied therein for improving pitch determination, said computer readable program code configured to cause a computer to perform:

obtaining an input voiced speech signal;

segmenting said input voiced speech signal into a plurality of windows of a sample size for pitch lag determination;

selecting a target window of said plurality of windows at an original position;

calculating a total energy of said target window by summing an energy of each of a plurality of samples within said target window;

sliding said target window in a first direction, with respect to said original position, by a sample to redefine said target window;

computing said total energy of said target window after said sliding;

repeating said sliding and said computing, for a pre-defined number of samples to obtain a total energy for each of said target windows;

determining a maximum total energy among every said total energy obtained from said target windows; and computing a pitch correlation based on said target window having said maximum total energy.

7. The computer program product of claim 6, wherein after said repeating and prior to said determining, said method further comprising:

sliding said target window in a second direction opposite to said first direction, with respect to said original position, by a sample to redefine said target window;

computing said total energy of said target window after said sliding said target window in said second direction; and repeating said sliding said target window in said second direction and said computing, for said pre-defined number of samples to obtain a total energy for each of said target windows.

8. The computer program product of claim 6, wherein said sliding maintains said sample size for each of said target windows.

9. The computer program product of claim 6, wherein said computing said total energy includes adding an energy value of an added sample and subtracting an energy value of a removed sample to said target window as a result of said sliding.

10. The computer program product of claim 6, wherein after said computing said pitch correlation, said method further comprises coding said input voiced speech signal using said pitch correlation.

11. A speech coding device including a microprocessor for improving pitch determination, the speech coding device comprising elements for:

obtaining an input voiced speech signal;

segmenting said input voiced speech signal into a plurality of windows of a sample size for pitch lag determination;

selecting a target window of said plurality of windows at an original position; calculating a total energy of said target window by summing an energy of each of a plurality of samples within said target window;

sliding said target window in a first direction, with respect to said original position, by a sample to redefine said target window;

computing said total energy of said target window after said sliding;

repeating said sliding and said computing, for a pre-defined number of samples to obtain a total energy for each of said target windows;

determining a maximum total energy among every said total energy obtained from said target windows; and computing a pitch correlation based on said target window having said maximum total energy.

12. The device of claim 11, wherein after said repeating and prior to said determining, said device further comprising elements for:

sliding said target window in a second direction opposite to said first direction, with respect to said original position, by a sample to redefine said target window;

computing said total energy of said target window after said sliding said target window in said second direction; and repeating said sliding said target window in said second direction and said computing, for said pre-defined number of samples to obtain a total energy for each of said target windows.

13. The device of claim 11, wherein said sliding maintains said sample size for each of said target windows.

14. The device of claim 11, wherein said computing said total energy includes adding an energy value of an added sample and subtracting an energy value of a removed sample to said target window as a result of said sliding.

15. The device of claim 11 further comprising an element for coding said input voiced speech signal using said pitch correlation.

* * * * *